US007898516B2

(12) United States Patent
Nakajima et al.

(10) Patent No.: US 7,898,516 B2
(45) Date of Patent: Mar. 1, 2011

(54) LIQUID CRYSTAL DISPLAY DEVICE AND MOBILE TERMINAL

(75) Inventors: Yoshiharu Nakajima, Kanagawa (JP); Yoshitoshi Kida, Kanagawa (JP)

(73) Assignee: Sony Corporation, Tokyo (JP)

( * ) Notice: Subject to any disclaimer, the term of this patent is extended or adjusted under 35 U.S.C. 154(b) by 678 days.

(21) Appl. No.: 10/559,074

(22) PCT Filed: Jun. 4, 2004

(86) PCT No.: PCT/JP2004/008168

§ 371 (c)(1),
(2), (4) Date: Nov. 17, 2006

(87) PCT Pub. No.: WO2004/109648

PCT Pub. Date: Dec. 16, 2004

(65) Prior Publication Data

US 2007/0052649 A1 Mar. 8, 2007

(30) Foreign Application Priority Data

Jun. 6, 2003 (JP) ..... 2003-161452

(51) Int. Cl.
*G09G 3/36* (2006.01)

(52) U.S. Cl. ..... 345/98

(58) Field of Classification Search ..... 345/87, 345/88, 89, 98–100, 204, 690
See application file for complete search history.

(56) References Cited

U.S. PATENT DOCUMENTS 6,380,917 B2 * 4/2002 Matsueda et al. ..... 345/89
6,411,273 B1 * 6/2002 Nakamura et al. ..... 345/98
6,894,674 B2 5/2005 Nakajima et al.
2002/0190974 A1 * 12/2002 Morita ..... 345/208
2003/0001800 A1 1/2003 Nakajima et al.

FOREIGN PATENT DOCUMENTS

JP 5-94154 4/1993

(Continued)

OTHER PUBLICATIONS

"S1D15714 Series", Seiko Epson Corporation, Electronic Devices Marketing Division, XP002388308, Jan. 1, 2003, p. 65.

(Continued)

*Primary Examiner*—Stephen G Sherman
(74) *Attorney, Agent, or Firm*—Oblon, Spivak, McClelland, Maier & Neustadt, L.L.P.

(57) ABSTRACT

A liquid crystal display is provided that allows miniaturization, cost lowering, thickness reduction, and saving of unnecessary spaces of the device, and enhancement of the reliability of the device. If a variable resistor is used to set the DC potential of a VCOM potential, miniaturization of a liquid crystal display is precluded since the size of the variable resistor is large. A DA converter is used instead of a conventional variable resistor as a unit for setting (adjusting) the DC potential of a VCOM potential (counter electrode voltage), and the DA converter is formed on the same glass substrate by using the same process as those of a display area part, to thereby achieve miniaturization of the liquid crystal display.

8 Claims, 5 Drawing Sheets

FOREIGN PATENT DOCUMENTS

| | | |
|---|---|---|
| JP | 9-106267 | 4/1997 |
| JP | 9-292595 | 11/1997 |
| JP | 2002-174823 | 6/2002 |

OTHER PUBLICATIONS

Hitachi, "HD66774 240-Channel Gate Driver for Color-TFT Liquid Crystal displays", Hitachi Datasheet, XP002493792, Rev.1.0 Jul. 2002, pp. 1-53.

S6B1713 65, "65 COM / 132 Seg Driver & Controller for STN LCD", Samsung Datasheet, XP 002493816, Mar. 2002, 4 cover pages and pp. 1-66.

Minseok Song S6D0114 Preliminary 132 RGB X 176 Dot 1-chip Driver IC with Internal Gram for 262, 144 Colors TFT-LCD, Samsung Datasheet, XP002493817, Jul. 3, 2002, pp. 1-143.

* cited by examiner

FIG. 4

| VC5 | VC4 | VC3 | VC2 | VC1 | SELECTED LINE | OUTPUT VOLTAGE[V] |
|---|---|---|---|---|---|---|
| L | L | L | L | L | NONE | Hi-Z |
| L | L | L | L | H | VCOMDC1 | VDD/2+0.075 |
| L | L | L | H | L | VCOMDC2 | VDD/2+0.05 |
| L | L | L | H | H | VCOMDC3 | VDD/2+0.025 |
| L | L | H | L | L | VCOMDC4 | VDD/2 |
| L | L | H | L | H | VCOMDC5 | VDD/2-0.025 |
| L | L | H | H | L | VCOMDC6 | VDD/2-0.05 |
| L | L | H | H | H | VCOMDC7 | VDD/2-0.075 |
| L | H | L | L | L | VCOMDC8 | VDD/2-0.1 |
| L | H | L | L | H | VCOMDC9 | VDD/2-0.125 |
| L | H | L | H | L | VCOMDC10 | VDD/2-0.15 |
| L | H | L | H | H | VCOMDC11 | VDD/2-0.175 |
| L | H | H | L | L | VCOMDC12 | VDD/2-0.2 |
| L | H | H | L | H | VCOMDC13 | VDD/2-0.225 |
| L | H | H | H | L | VCOMDC14 | VDD/2-0.25 |
| L | H | H | H | H | VCOMDC15 | VDD/2-0.275 |
| H | L | L | L | L | VCOMDC16 | VDD/2-0.3 |
| H | L | L | L | H | VCOMDC17 | VDD/2-0.325 |
| H | L | L | H | L | VCOMDC18 | VDD/2-0.35 |
| H | L | L | H | H | VCOMDC19 | VDD/2-0.375 |
| H | L | H | L | L | VCOMDC20 | VDD/2-0.4 |
| H | L | H | L | H | VCOMDC21 | VDD/2-0.425 |
| H | L | H | H | L | VCOMDC22 | VDD/2-0.45 |
| H | L | H | H | H | VCOMDC23 | VDD/2-0.475 |
| H | H | L | L | L | VCOMDC24 | VDD/2-0.5 |
| H | H | L | L | H | VCOMDC25 | VDD/2-0.525 |
| H | H | L | H | L | VCOMDC26 | VDD/2-0.55 |
| H | H | L | H | H | VCOMDC27 | VDD/2-0.575 |
| H | H | H | L | L | VCOMDC28 | VDD/2-0.6 |
| H | H | H | L | H | VCOMDC29 | VDD/2-0.625 |
| H | H | H | H | L | VCOMDC30 | VDD/2-0.65 |
| H | H | H | H | H | VCOMDC31 | VDD/2-0.675 |

LIQUID CRYSTAL DISPLAY DEVICE AND MOBILE TERMINAL

TECHNICAL FIELD

The present invention relates to a liquid crystal display and a portable terminal, and particularly to a liquid crystal display having a circuit for producing a counter electrode voltage that is applied, in common to pixels, to the counter electrode of liquid crystal cells, and a portable terminal employing the liquid crystal display as its screen display part.

BACKGROUND ART

In recent years, spread of portable terminals, such as cellular phones and PDAs (Personal Digital Assistants; portable information terminals), have been remarkable. One factor of the rapid spread of these portable terminals is liquid crystal displays included as a screen display part of the portable terminals. The reason for this is that the liquid crystal displays are display devices that have a characteristic of requiring no power for driving themselves in principle, and therefore are of low power consumption.

In the liquid crystal display, in order to prevent the deterioration of resistivity (resistance specific to a substance) of the liquid crystal due to continuous application of a DC voltage having the same polarity to the liquid crystal, a driving method is adopted in which the polarity of a display signal written to each pixel is inverted with a period of 1H (1 horizontal period) or 1F (1 field period). Furthermore, a driving method is also used in which a counter electrode voltage VCOM that is applied, in common to the pixels, to the counter electrode of liquid crystal cells is inverted with a period of 1H or 1F, to thereby lower voltage of the horizontal drive circuit.

In the liquid crystal display, a display signal is written from the horizontal drive circuit to each pixel via a signal line. When the display signal is written to the pixel electrode of the liquid crystal cell via a pixel transistor for each pixel, voltage drop arises in the pixel transistor due to the parasitic capacitance and the like of the transistor. Therefore, as the counter electrode voltage VCOM, an AC voltage having a DC level shifted (offset) for the voltage drop is used. Note that a DC voltage is used as the counter electrode voltage VCOM instead of AC voltage in some cases.

In order to thus implement DC shift for the counter electrode voltage VCOM, i.e., adjust the DC level of the counter electrode voltage VCOM, conventionally, a variable resistor is provided outside a glass substrate having a display area part in which pixels are two-dimensionally arranged in rows and columns, and the DC level of the counter electrode voltage VCOM is adjusted by use of the variable resistor on each display panel basis (for example, refer to Japanese Patent Laid-open No. 2002-174823 (paragraph 0030 and FIG. 7(B) in particular)).

However, if a variable resistor is provided as an external part in order to adjust the DC level of the counter electrode voltage VCOM like the liquid crystal display according to the above-described conventional example, the size of the liquid crystal display is increased since the size of the variable resistor is large. Accordingly, when the liquid crystal display is provided for a small portable terminal such as a cellular phone, the miniaturization of the terminal main body is problematically precluded. In addition, there also arises a problem in that the adjustment by a variable resistor cannot ensure sufficient reliability.

The present invention is made in consideration of the above-described problems, and a desire thereof is to provide a liquid crystal display that allows miniaturization of the device main body and enhancement of the reliability, and a portable terminal employing the liquid crystal display as its screen display part.

DISCLOSURE OF INVENTION

A liquid crystal display according to the present invention includes a display area part that includes pixels having a liquid crystal cell and being two-dimensionally arranged in rows and columns, and a DA converter that is formed on the same substrate by using the same process as those of the display area part, and adjusts a direct current potential of a counter electrode voltage applied to a counter electrode of the liquid crystal cell based on digital data supplied from the external of the substrate. This liquid crystal display is used as a screen display part of portable terminals typified by cellular phones and PDAs.

In the liquid crystal display with the above-described configuration or the portable terminal employing it as its screen display part, the DA converter is used instead of a conventional variable resistor as a unit for adjusting the direct current potential of the counter electrode voltage, and the DA converter is formed on the same substrate by using the same process as those of the display area part. Thus, miniaturization of the device can be achieved due to absence of an external part (variable resistor) having large size. Moreover, cost lowering attributed to the simplification of the fabrication process, and thickness reduction and saving of unnecessary spaces of the device attributed to the integration can be achieved. In addition, regarding the adjustment of the direct current potential, reliability can be enhanced compared with a variable resistor.

BRIEF DESCRIPTION OF DRAWINGS

FIG. 4 is a diagram illustrating correspondence among parallel data VC5 to VC1, reference voltages VCOMDC1 to VCOMDC31, and actual output voltages.

BEST MODE FOR CARRYING OUT THE INVENTION

Embodiments of the present invention will be described in detail below with reference to the accompanying drawings.

Figure 1:
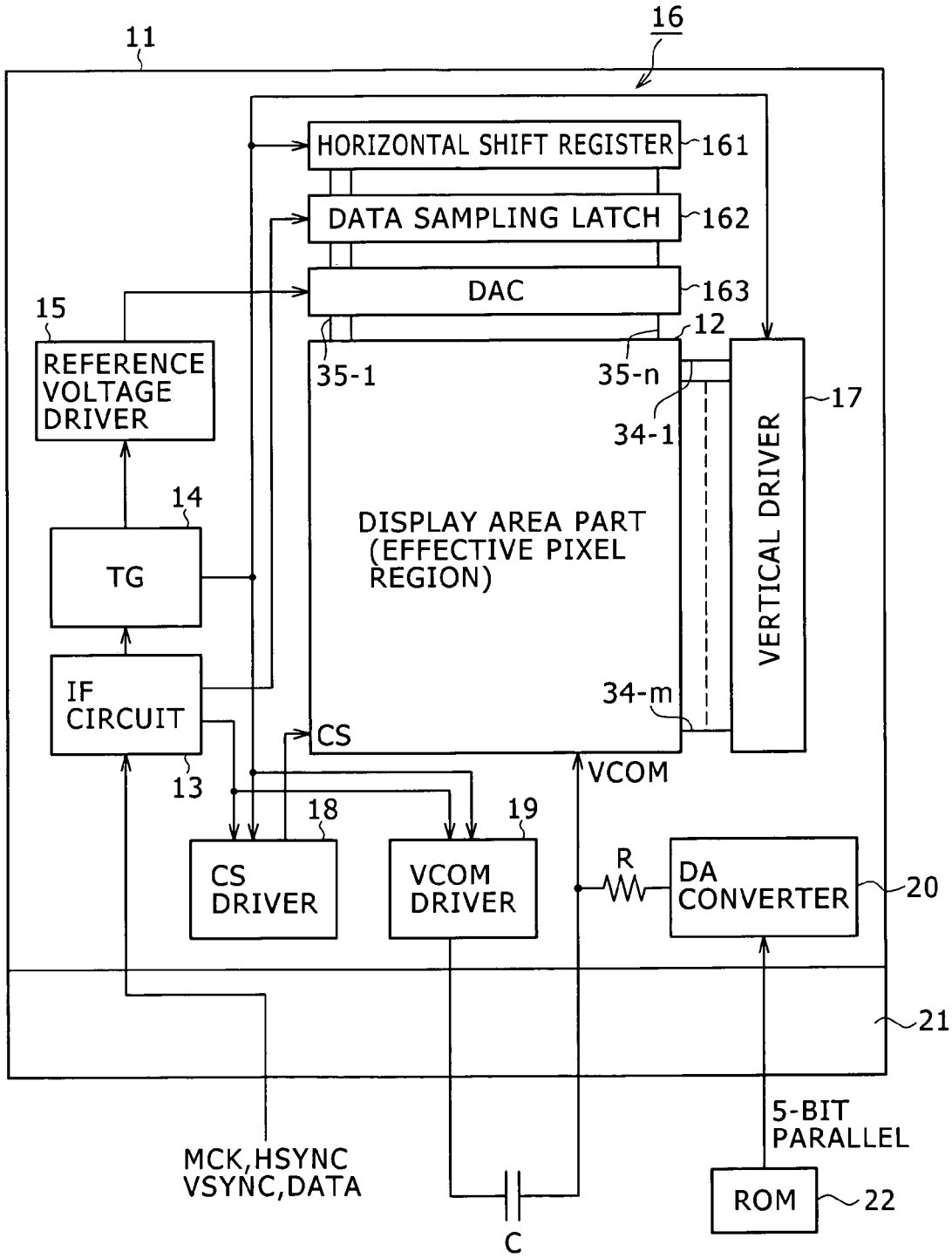
FIG. 1 is a block diagram illustrating an example of the configuration of a liquid crystal display according to one embodiment of the present invention.

FIG. 1 is a block diagram illustrating an example of the configuration of a liquid crystal display according to one embodiment of the present invention. Referring to FIG. 1, formed on a transparent insulating substrate, e.g., a glass substrate 11 is a display area part (pixel part) 12 including pixels that are two-dimensionally arranged in rows and columns. The glass substrate 11 is disposed facing another glass substrate with a certain gap therebetween, and a liquid crystal material is enclosed between the substrates to thereby construct a display panel (LCD panel).

Figure 2:
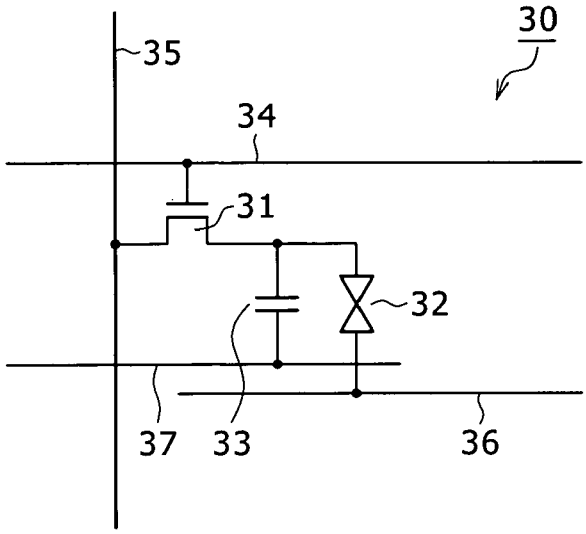
FIG. 2 is a circuit diagram illustrating an example of the configuration of a pixel circuit of a display area part.

FIG. 2 illustrates one example of the configuration of each pixel in the display area part 12. Referring to FIG. 2, each of two-dimensionally arranged pixels 30 includes a TFT (Thin Film Transistor) 31 that is a pixel transistor, a liquid crystal cell 32 whose pixel electrode is coupled to the drain electrode of the TFT 31, and a storage capacitance 33 whose one electrode is coupled to the drain electrode of the TFT 31. The liquid crystal cell 32 means liquid crystal capacitance generated between the pixel electrode and the counter electrode formed facing the pixel electrode.

In the pixel configuration, the gate electrode of the TFT 31 is coupled to a gate line (scan line) 34, and the source electrode thereof is coupled to a data line (signal line) 35. The counter electrode of the liquid crystal cell 32 of each pixel is coupled to a VCOM line 36 in a common manner. A common voltage (counter electrode voltage) VCOM (VCOM potential) is applied, in common to the pixels, via the VCOM line 36 to the counter electrode of the liquid crystal cell 32. The other electrode of the storage capacitance 33 of each pixel is coupled to a CS line 37 in a common manner.

When implementing 1H inversion driving or 1F inversion driving, the polarity of a display signal written to each pixel is inverted based on the VCOM potential. Moreover, when VCOM inversion driving for inverting the polarity of the VCOM potential with a period of 1H or 1F is also used together with the 1H inversion driving or 1F inversion driving, the polarity of a CS potential applied to the CS line 37 is also inverted in sync with the VCOM potential. However, a liquid crystal display according to the present embodiment is not limited to one employing the VCOM inversion driving.

Referring again to FIG. 1, various circuits are provided on the same glass substrate 11 as that of the display area part 12. For example, provided to the left of the display area part 12 are an interface (IF) circuit 13, a timing generator (TG) 14 and a reference voltage driver 15. Provided above the display area part 12 is a horizontal driver 16. Provided to the right of the display area part 12 is a vertical driver 17. Provided below the display area part 12 are a CS driver 18, a VCOM driver 19 and a DA converter 20. These circuits are fabricated together with the pixel transistors of the display area part 12 by using low-temperature poly-silicon or CG (Continuous Grain) silicon.

In the active matrix liquid crystal display with the above-described configuration, input from the external via a flexible substrate 21 to the glass substrate 11 are a master clock MCK, a horizontal synchronous pulse Hsync, a vertical synchronous pulse Vsync and display data Data input in parallel as to R (red), G (green) and B (blue) that all have a low voltage swing (e.g., 3.3 V swing). The interface circuit 13 implements level shift (level conversion) so that these input signals are shifted (converted) to have a high voltage swing (e.g., 6.5 V swing).

The master clock MCK, the horizontal synchronous pulse Hsync, and the vertical synchronous pulse Vsync resulting from the level shift by the interface circuit 13 are supplied to the timing generator 14. The timing generator 14 generates various kinds of timing pulses necessary to drive the reference voltage driver 15, the horizontal driver 16 and the vertical driver 17 based on the master clock MCK, the horizontal synchronous pulse Hsync, and the vertical synchronous pulse Vsync. The display data Data resulting from the level shift by the interface circuit 13 is supplied to the horizontal driver 16.

The horizontal driver 16 includes at least a horizontal shift register 161, a data sampling latch circuit 162 and a DA (digital to analog) converter (DAC) 163, for example. The horizontal shift register 161 initializes the shift operation in response to a horizontal start pulse HST supplied from the timing generator 14, and generates sampling pulses to be sequentially transferred in one horizontal period in sync with a horizontal clock pulse HCK supplied also from the timing generator 14.

The data sampling latch circuit 162 sequentially samples and latches in one horizontal period the display data Data output from the interface circuit 13, in sync with the sampling pulses generated by the horizontal shift register 161. The latched digital data of one line is further transferred to a line memory (not shown) in a horizontal blanking period. The digital data of one line is then converted to analog display signals by the DA converter 163.

The DA converter 163 is a reference voltage selection DA converter, for example, that selects each reference voltage corresponding to digital data among reference voltages corresponding to the number of grayscales applied from the reference voltage driver 15, and outputs the selected reference voltage as an analog display signal. Analog display signals Sig of one line output from the DA converter 163 are output to data lines 35-1 to **35-*n* provided corresponding to the number of pixels n in the horizontal direction in the display area part 12**.

The vertical driver 17 is composed of a vertical shift register and a gate buffer. In the vertical driver 17, the vertical shift register initializes the shift operation in response to a vertical start pulse VST supplied from the timing generator 14, and generates scan pulses to be sequentially transferred in one vertical period in sync with a vertical clock pulse VCK supplied also from the timing generator 14. The generated scan pulses are sequentially output via the gate buffer to gate lines 34-1 to **34-*m* provided corresponding to the number of pixels m in the vertical direction in the display area part 12**.

When the scan pulses are sequentially output to the gate lines 34-1 to **34-*m* due to the vertical scanning by the vertical driver 17, each pixel of the display area part 12 is selected in order on a row (line) basis. To the selected pixels of one line, the analog display signals Sig of one line output from the DA converter 163 are simultaneously written via the data lines 35-1 to 35-*n***. This writing operation on a line basis is repeated, and thus an image of one screen is displayed.

The CS driver 18 generates the above-described CS potential, and applies it, in common to the pixels, via the CS line 37 of FIG. 2 to the other electrode of the storage capacitance 33. Assuming that the amplitude of the display signal is 0-3.3 V for example, if the VCOM inversion driving is adopted, the CS potential repeats AC inversion, with its low level being 0 V (ground level) and its high level being 3.3 V.

The VCOM driver 19 generates the above-described VCOM potential. The VCOM potential output from the VCOM driver 19 is output via the flexible substrate 21 to the outside of the glass substrate 11. The VCOM potential output to the outside of the substrate passes through an external capacitor C for coupling provided outside the glass substrate 11, and then is brought into the glass substrate 11 again via the flexible substrate 21. The VCOM potential is applied, in common to the pixels, via the VCOM line 36 of FIG. 2 to the counter electrode of the liquid crystal cell 32.

As the VCOM potential, an AC voltage having almost the same swing as that of the CS potential is used. Actually, however, when a signal is written from the data line 35 via the TFT 31 to the pixel electrode of the liquid crystal cell 32 in FIG. 2, voltage drop arises in the TFT 31 due to the parasitic capacitance and the like of the TFT 31. Therefore, as the VCOM potential, an AC voltage having a DC level shifted (offset) toward a lower level for the voltage drop needs to be used. The DA converter 20 takes a role of implementing the DC shift of the VCOM potential, i.e., adjusting the DC potential.

The output end of the DA converter 20 is coupled via a resistor R to the output end of the external capacitor C and the VCOM line 36 (refer to FIG. 2) of the display area part 12. Thus, the DA converter 20 adjusts the DC potential (implements DC shift) of the VCOM potential input into the glass substrate 11 via the capacitor C. Specifically, a ROM 22 that is a storage provided outside the glass substrate 11 stores digital data corresponding to voltage drop specific to the display panel in advance. The DA converter 20 adjusts the DC potential of the VCOM potential based on the digital data.

Here, the resistor R and the capacitor C constitute a differentiator. In order to prevent a loss (variation) of pulse waveform of the VCOM potential due to the effect of the differentiator, the time constant of the differentiator determined depending on the resistance of the resistor R and the capacitance of the capacitor C needs to be set sufficiently larger than the inversion period of the VCOM potential. For this reason, the resistor R having comparatively large resistance is used.

Figure 3:
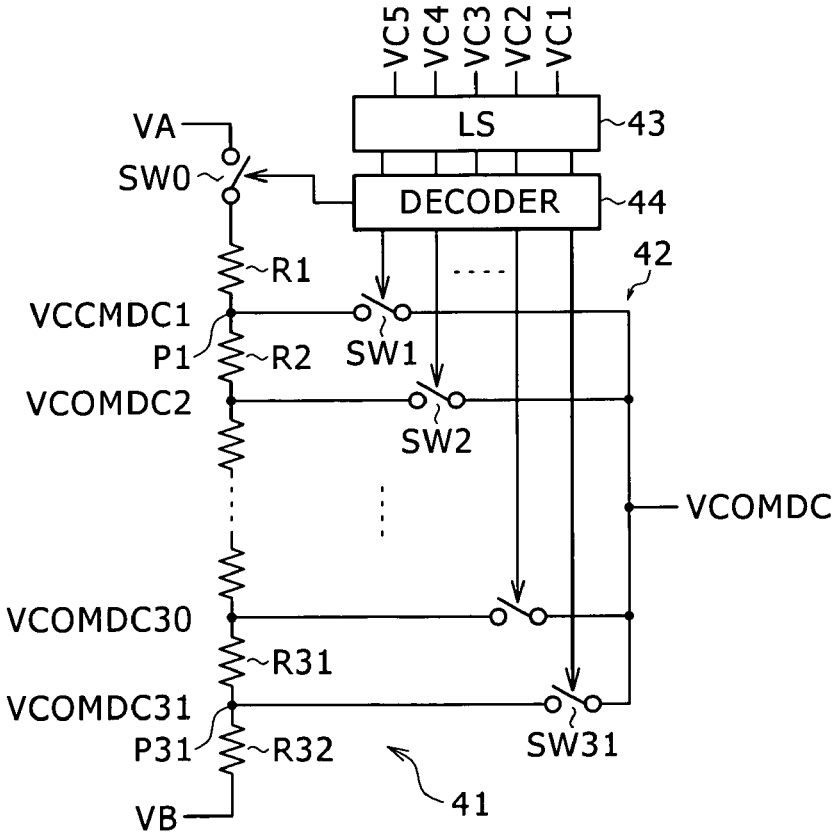
FIG. 3 is a circuit diagram illustrating one example of the configuration of a reference voltage selection DA converter.

FIG. 3 is a circuit diagram illustrating one example of the configuration of the DA converter 20. As is apparent from FIG. 3, the DA converter 20 according to the present example has the circuit configuration of a reference voltage selection DA converter that includes a reference voltage generation circuit 41, a switch circuit 42, a level shift (LS) circuit 43 and a decoder 44. The DA converter 20 is fed with, for example, five bits of parallel data VC5 to VC1 from the ROM 22 outside the substrate. The number of bits of the parallel data is not limited to five.

The reference voltage generation circuit 41 is composed of a resistance dividing circuit. Specifically, the reference voltage generation circuit 41 includes a number of resistors corresponding to the five bits of parallel data VC5 to VC1, i.e., thirty-two resistors R1 to R32 that are connected in series between a first reference potential VA and a second reference potential VB, with a switch SW0 being connected between the resistors and the first reference potential VA. The reference voltage generation circuit 41 generates, by resistance division, thirty-one reference voltages VCOMDC1 to VCOMDC31 at voltage division nodes P1 to P31 between the respective adjacent two of the resistors R1 to R32. The switch SW0 is made up of a PchMOS switch for example.

The switch circuit 42 is composed of thirty-one switches SW1 to SW31. One end of each of the switches SW1 to SW31 is coupled to a respective one of the voltage division nodes P1 to P31 of the reference voltage generation circuit 41. The other ends of the switches are connected in common to constitute the output end of the switch circuit 42. The switches SW1 to SW31 are made up of a CMOS switch for example. The level shift circuit 43 implements level shift to convert the parallel data VC5 to VC1 of a low voltage swing (e.g., 3.3 V swing) to parallel data of a high voltage swing (e.g., 6.5 V swing).

The decoder 44 decodes the parallel data VC5 to VC1 resulting from the level shift by the level shift circuit 43, and selectively turns on (closes) one of the switches SW1 to SW31 according to the decoding result, to thereby select the reference voltage corresponding to the parallel data VC5 to VC1 among thirty-one reference voltages VCOMDC1 to VCOMDC31. In addition, the decoder 44 turns off (opens) the switch SW0, which is normally in the on state, when all of the parallel data VC5 to VC1 are at the L level (logic 0), to thereby cause the output of the DA converter 20 to enter a high impedance state.

FIG. 4 illustrates correspondence among the parallel data VC5 to VC1, the reference voltages VCOMDC1 to VCOMDC31, and actual output voltages. Here, with the swing of the VCOM potential output from the VCOM driver 19 being defined as VDD, the reference voltage output is designed so that the reference voltage VCOMDC4 is selected when the parallel data VC5, VC4, VC3, VC2 and VC1 are L, L, H, L and L, respectively, and the reference voltage VCOMDC4 equals VDD/2.

The output voltage VDD/2 is equivalent to the center level of swing of the VCOM potential. Therefore, selecting the reference voltage VCOMDC4 means that the DC level is not shifted. Furthermore, the reference voltages are designed to vary from the voltage VCOMDC1 to the voltage VCOMDC31 in decrements of 0.025 V, with the output voltage VDD/2 as a basis. When all the parallel data VC5 to VC1 are at the L level, the switch SW0 is turned off as described above. Thus, the reference voltages VCOMDC1 to VCOMDC31 are not selected and the output of the DA converter 20 enters a high impedance (Hi-Z) state.

When the DA converter 20 having the above-described configuration is integrated on the same glass substrate 11 as that of the display area part 12, together with peripheral drive circuits such as the horizontal driver 16 and the vertical driver 17, thin film transistors are preferably used as transistors constituting the switch circuit 42, the level shift circuit 43 and the decoder 44 since thin film transistors are used as the pixel transistors of the display area part 12. In recent years, integration of the thin film transistors has been facilitated in step with enhancement of performance and reduction of power consumption thereof. Therefore, by forming the DA converter 20 on the same glass substrate 11 by using the same process as those of the display area part 12, cost lowering attributed to the simplification of the fabrication process, and thickness reduction and saving of unnecessary spaces of the device attributed to the integration can be achieved.

As described above, in the active matrix liquid crystal display according to the present embodiment, provided on the same substrate (glass substrate 11) as that of the display area part 12 are, in addition to the horizontal driver 16 and the vertical driver 17, peripheral drive circuits such as the interface circuit 13, the timing generator 14, the reference voltage driver 15, the CS driver 18, the VCOM driver 19 and the DA converter 20. Thus, a display panel (LCD panel) in which all the drive circuits are integrated can be constructed. In addition, since there is no need to provide another substrate, ICs and transistor circuits outside the display panel, miniaturization of the entire system and cost lowering can be achieved.

In particular, the DA converter 20 is used instead of a conventional variable resistor as a unit for adjusting the DC potential of the VCOM potential (counter electrode voltage), and the DA converter 20 is formed on the same glass substrate 11 by using the same process as those of the display area part 12. Accordingly, miniaturization of the device can be achieved due to absence of an external part (variable resistor) having large size. Moreover, cost lowering attributed to the simplification of the fabrication process, and thickness reduction and saving of unnecessary spaces of the device attributed to the integration can be achieved.

In addition, since a reference voltage selection DA converter is used as the DA converter 20, reliability can be enhanced regarding adjustment of the DC potential of the VCOM potential compared with a variable resistor. This is because the reference voltage selection DA converter is robust against variation in the absolute value of the output potential and is effective particularly when forming the DA converter with using thin film transistors involving large characteristic variation.

Furthermore, a resistance dividing circuit is used as the reference voltage generation circuit 41. If the resistance of the resistors R1 to R31 of the resistance dividing circuit is set sufficiently large, the resistor R having comparatively large resistance, which is coupled to the output end of the DA converter 20 in FIG. 1, can be omitted, which is convenient for simplification of the entire configuration of peripheral drive circuits on the glass substrate 11 and size reduction of the frame of the display panel (size reduction of the peripheral region of the display area part 12). Note that the resistance of each of the resistors R1 to R31 is set so that the total resistance of the resistors is close to the resistance of the resistor R.

In some cases, a set equipped with the liquid crystal display, i.e., an LCD module according to the present embodiment may not include the ROM 22 that stores digital data for adjusting the DC potential of the VCOM potential in advance. It should be obvious that, also when applying the LCD module to such a liquid crystal display system, the LCD module needs a unit for adjusting the DC potential of the VCOM potential since no adjustment of the DC potential of the VCOM potential fails to achieve favorable displayed images.

Therefore, an advantageous feature is provided for the liquid crystal display according to the present embodiment so that the DC potential of the VCOM potential can be adjusted using an external circuit such as a variable resistor like conventional displays even when the liquid crystal display is applied to a liquid crystal display system that does not include the ROM 22. Specifically, particular setting is implemented in order to carry out the adjustment with using an external circuit. More specifically, all the parallel data VC5 to VC1 input to the decoder 44 are set to the L level, and thus the switch SW0 enters the off state. As a result, the output of the DA converter 20 enters a high impedance state, which enables an external circuit for adjusting the DC potential of the VCOM potential to be coupled to the output of the capacitor C.

It should be obvious that, when adopting this configuration, a terminal to be coupled to the external circuit for adjusting the DC potential of the VCOM potential needs to be provided for the output of the capacitor C in advance. In addition, all the parallel data VC5 to VC1 input to the decoder 44 can easily be set to the L level by coupling to the ground (grounding) the terminal for loading the parallel data VC5 to VC1 into the inside of the substrate for example.

Figure 5:
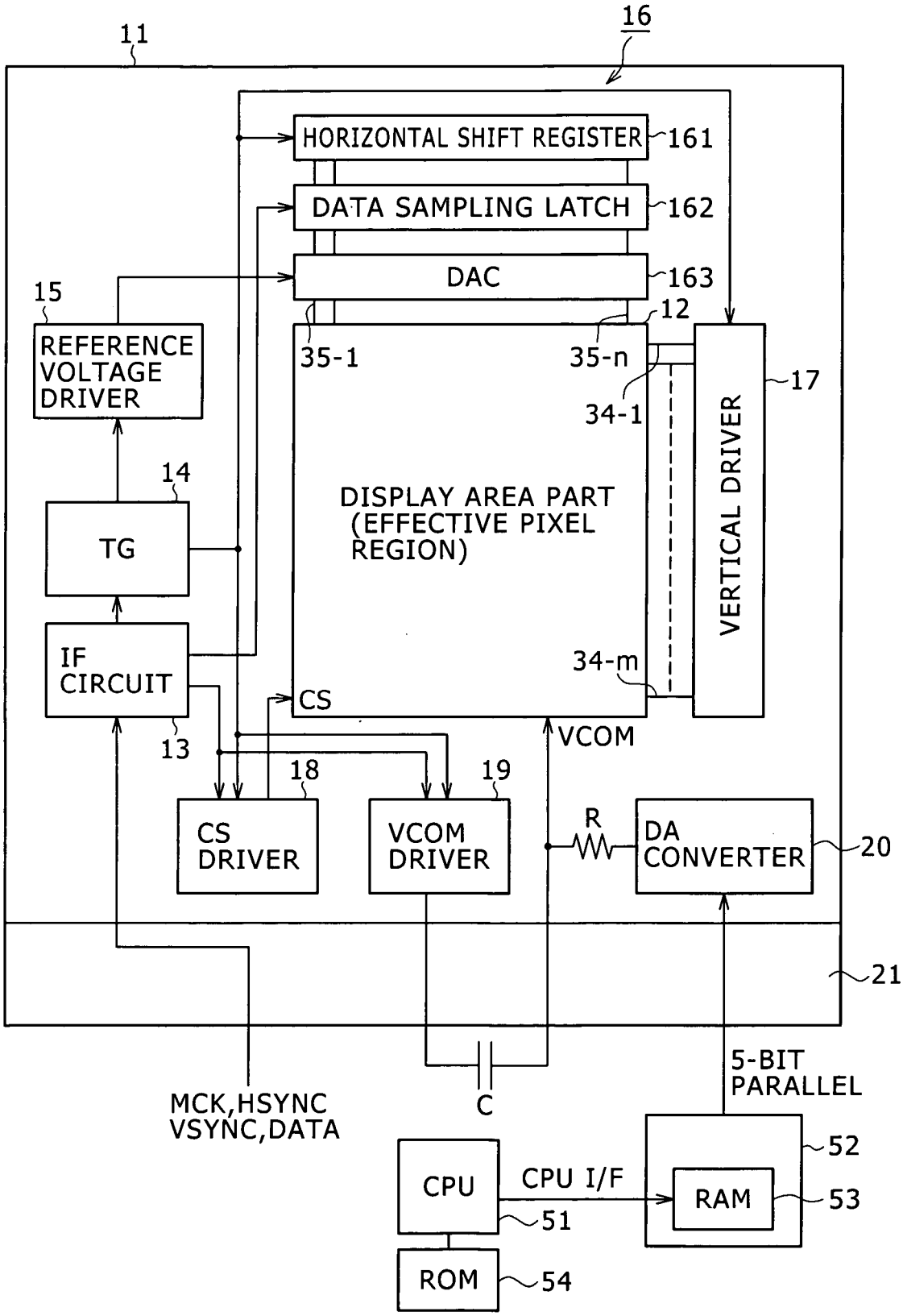
FIG. 5 is a block diagram illustrating an example of the configuration of a liquid crystal display according to a modification of the present invention.

In the above-described embodiment, digital data specific to the display panel is stored in the ROM 22 provided outside the substrate for adjusting the DC potential of the VCOM potential, and the DC potential of the VCOM potential is adjusted based on the digital data. Alternatively, as shown in FIG. 5, the following configuration is also possible: a RAM 53 storing digital data for adjusting the DC potential is provided on an interface IC 52 that intervenes between a CPU for controlling the entire system and the present liquid crystal display (display panel), and digital data specific to the display panel is stored in a ROM 54 coupled to the CPU 51.

When this configuration is employed, the CPU 51 sends to the interface IC 52 a setting signal based on the digital data specific to the display panel stored in the ROM 54. Consequently, the interface IC 52 decodes the setting signal sent from the CPU 51 and stores it in the RAM 53. The interface IC 52 then supplies the digital data stored in the RAM 53 to the DA converter 20 on the glass substrate 11. Thus, the optimum VCOM potential having the shifted DC potential corresponding to setting value stored in the ROM 54 coupled to the CPU 51 can be applied to the counter electrode of each pixel in the display area part 12.

APPLICATION EXAMPLE

Figure 6:
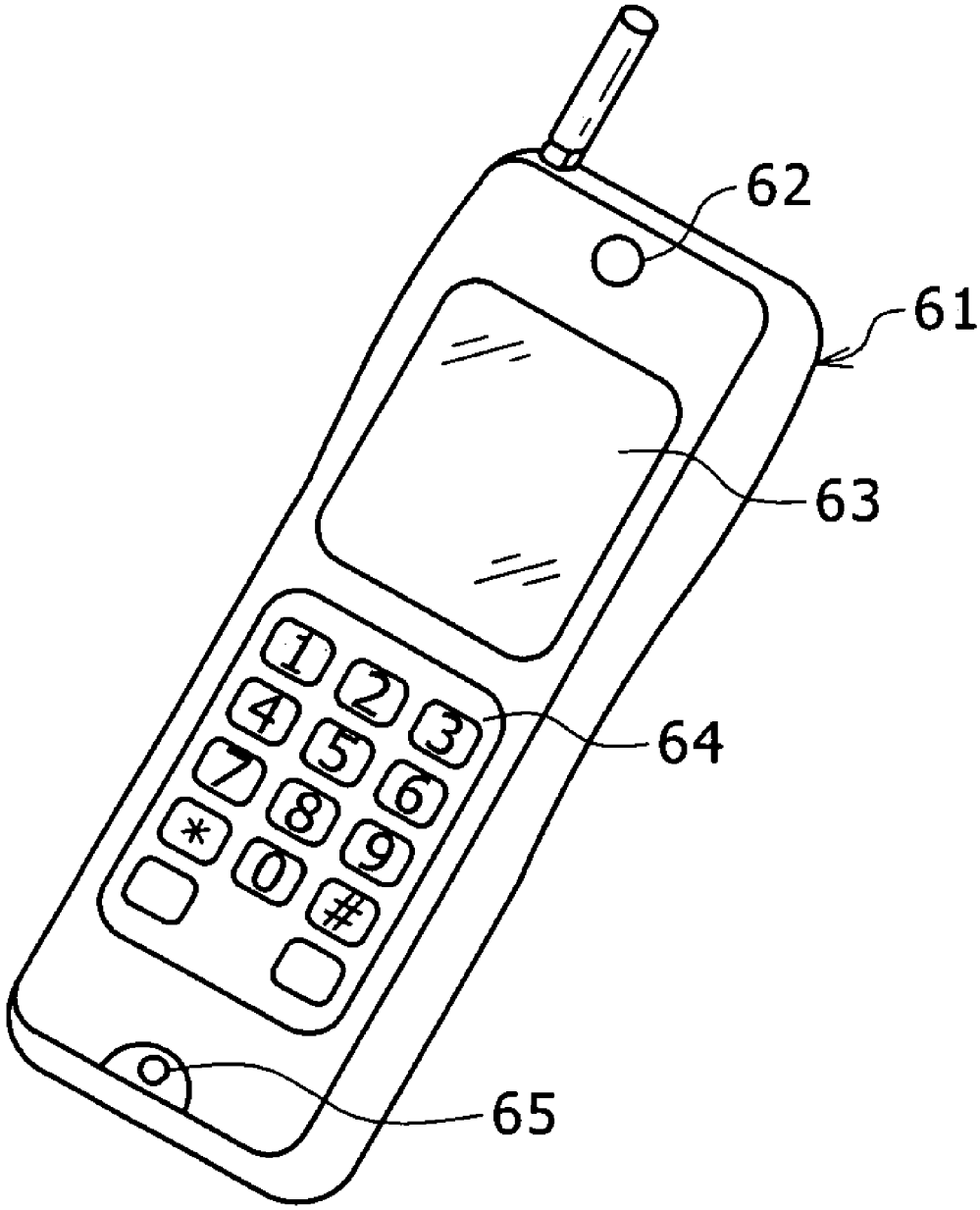
FIG. 6 is an outside drawing illustrating the schematic configuration of a cellular phone to which the present invention is applied.

FIG. 6 is an outside drawing illustrating the schematic configuration of a portable terminal, e.g., a cellular phone to which the present invention is applied.

The cellular phone according to this example has a configuration in which a speaker 62, a screen display part 63, an operation part 64 and a microphone 65 are disposed on the front side of a device case 61 in that order from the upper side of the phone. In the cellular phone with such a configuration, a liquid crystal display is used for the screen display part 63, and as the liquid crystal display, one according to the above-described embodiment is used.

If the liquid crystal display according to the above-described embodiment is thus used as the screen display part 63 in a portable terminal typified by cellular phones and PDAs, cost lowering attributed to the simplification of the fabrication process, and thickness reduction and saving of unnecessary spaces of the device attributed to the integration can be achieved since the liquid crystal display employs a DA converter instead of a conventional variable resistor as a unit for adjusting the DC potential of the VCOM potential, and the DA converter is formed on the same substrate by using the same process as those of the display area part. Therefore, the liquid crystal display can significantly contribute to miniaturization, cost lowering, thickness reduction and saving of unnecessary spaces of the portable terminal.

As described above, according to the present invention, a DA converter is used instead of a conventional variable resistor as a unit for adjusting the DC potential of a counter electrode voltage, and the DA converter is formed on the same substrate by using the same process as those of a display area part. Thus, miniaturization of the device can be achieved due to absence of an external part having large size. Moreover, cost lowering attributed to the simplification of the fabrication process, and thickness reduction and saving of unnecessary spaces of the device attributed to the integration can be achieved. Furthermore, reliability can be enhanced compared with a variable resistor.

The invention claimed is:

1. A liquid crystal display comprising:

a display area part that includes pixels having a liquid crystal cell and being two-dimensionally arranged in rows and columns; and a DA converter that is formed on the same substrate by using the same process as those of said display area part, and adjusts a direct current potential of a counter electrode voltage applied to a counter electrode of said liquid crystal cell based on digital data supplied from the external of the substrate, the DA converter including a decoder and a plurality of switches, the decoder configured to control the plurality of switches based on the digital data supplied to the DA converter, the decoder configured to change an output of the DA converter to a high impedance state when the digital data is zero, the output of the DA converter entering the high impedance state when a first switch of the plurality of switches is opened and regardless of a state of a rest of the plurality of switches, the first switch being connected between two reference potentials in a reference potential generation circuit of the DA converter, the decoder configured to close the first switch and one of the other of the plurality of switches when the digital data is not zero such that the output of the DA converter adjusts the direct current potential of the counter electrode voltage.

2. The liquid crystal display according to claim 1, wherein said DA converter includes a reference voltage generation circuit that generates a plurality of reference voltages having different voltage values, the reference voltage generation circuit selecting among said plurality of reference voltages a reference voltage having a voltage value corresponding to said digital data and outputting the selected reference voltage as said direct current potential.

3. The liquid crystal display according to claim 2, wherein said reference voltage generation circuit is composed of a resistance dividing circuit including a plurality of resistors that are connected in series between two reference potentials, the resistance dividing circuit generating by resistance division said plurality of reference voltages between the respective adjacent two of said plurality of resistors.

4. The liquid crystal display according to claim 1, wherein the decoder is configured to close the first switch and only one of the other of the plurality of switches when the digital data is not zero such that the output of the DA converter adjusts the direct current potential of the counter electrode voltage.

5. A portable terminal employing a liquid crystal display as a screen display part, the liquid crystal display comprising:

a display area part that includes pixels having a liquid crystal cell and being two-dimensionally arranged in rows and columns;

a DA converter that is formed on the same substrate by using the same process as those of said display area part, and adjusts a direct current potential of a counter electrode voltage applied to a counter electrode of said liquid crystal cell based on digital data supplied from the external of the substrate, the DA converter including a decoder and a plurality of switches, the decoder configured to control the plurality of switches based on the digital data supplied to the DA converter, the decoder configured to change an output of the DA converter to a high impedance state when the digital data is zero, the output of the DA converter entering the high impedance state when a first switch of the plurality of switches is opened and regardless of a state of a rest of the plurality of switches, the first switch being connected between two reference potentials in a reference potential generation circuit of the DA converter, the decoder configured to close the first switch and one of the other of the plurality of switches when the digital data is not zero such that the output of the DA converter adjusts the direct current potential of the counter electrode voltage.

6. The portable terminal according to claim 5, wherein said DA converter includes a reference voltage generation circuit that generates a plurality of reference voltages having different voltage values, the reference voltage generation circuit selecting among said plurality of reference voltages a reference voltage having a voltage value corresponding to said digital data and outputting the selected reference voltage as said direct current potential.

7. The portable terminal according to claim 6, wherein said reference voltage generation circuit is composed of a resistance dividing circuit including a plurality of resistors that are connected in series between two reference potentials, the resistance dividing circuit generating by resistance division said plurality of reference voltages between the respective adjacent two of said plurality of resistors.

8. The portable terminal according to claim 5, wherein the decoder is configured to close the first switch and only one of the other of the plurality of switches when the digital data is not zero such that the output of the DA converter adjusts the direct current potential of the counter electrode voltage.

* * * * *